United States Patent [19]

Tsuchiya et al.

[11] Patent Number: 4,892,490

[45] Date of Patent: Jan. 9, 1990

[54] ELECTRICAL CONNECTOR ENABLING PREVENTION OF INCOMPLETE COUPLING

[75] Inventors: Yoshikazu Tsuchiya; Hideki Kano; Yasuyuki Aihara; Noboru Miyazaki; Izumi Suzuki; Kiyofumi Ichida, all of Tochigi, Japan

[73] Assignees: Honda Giken Kogyo K.K., Tokyo; Sumitomo Wiring System, Ltd., Mie, both of Japan

[21] Appl. No.: 284,114

[22] Filed: Dec. 14, 1988

[30] Foreign Application Priority Data

Dec. 15, 1987 [JP] Japan ..... 62-190398[U]
Dec. 15, 1987 [JP] Japan ..... 62-190399[U]

[51] Int. Cl.[4] ..... H01R 13/60

[52] U.S. Cl. ..... 439/533; 439/489; 439/345

[58] Field of Search ..... 439/34, 357, 488, 489, 439/491, 350, 351, 352, 353, 354, 355, 356, 358, 527, 533, 529, 345, 369

[56] References Cited

U.S. PATENT DOCUMENTS 4,634,204 1/1987 Detter et al. ..... 439/488 X
4,708,413 11/1987 Schroeder ..... 439/358

*Primary Examiner*—Neil Abrams
*Assistant Examiner*—Khiem Nguyen
*Attorney, Agent, or Firm*—Wenderoth, Lind & Ponack

[57] ABSTRACT

In an electrical connector, a male connector body and a female connector body are coupled and locked together to effect the mechanical connection of electrical terminals housed in the respective connector bodies. To prevent incomplete coupling of the relevant connector bodies, a path is formed in the male connector body in such a manner as to correspond to the shape and dimension of a bracket for fixing the electrical connector to the body of an automotive vehicle or components thereof, and a rib is provided on the female connector body in such a manner as to traverse the path. This rib blocks a part of the path when the two connector bodies are improperly coupled with each other, thus making it possible to detect incomplete coupling. An electrical connector of another type has another configuration for the same purpose. In this second type of electrical connector, a support finger and a detection finger are provided on a bracket, and a path is formed in the male connector body in such a manner as to correspond to the shape and dimension of the support finger, a rib being provided on the rearward portion of the female connector body. This rib is adapted to be abutted by the detection finger when the relevant two connector bodies are improperly coupled with each other, and this serves to prevent entry of the support finger into the path, thus enabling detection of incomplete coupling.

2 Claims, 5 Drawing Sheets

ELECTRICAL CONNECTOR ENABLING PREVENTION OF INCOMPLETE COUPLING

BACKGROUND OF THE INVENTION

1. Field of the Invention

The present inventon relates to an electrical connector adapted to ensure complete coupling of associated connector bodies (hereinafter, referred to simply as an electrical connector) for use in wire harnesses for automotive vehicles or the like.

2. Statement of the Prior Art

In a conventional electrical connector, a male connector body and a female connector body are coupled and locked together to effect the mechanical connection of electrical terminals housed in the respective connector bodies. It has been conventional practice to confirm whether or not a connector is in locked engagement by manually sensing the state of engagement or listening to the snapping sound which is heard when the relevant connector bodies assume a locked state.

However, confirmation solely by sensation is very imprecise and proper confirmation is unlikely to be achieved if unskilled workers are employed for this task. The method of confirmation which relies on listening to the snapping sounds is also unreliable since it is difficult to perform this task in certain types of working environments.

Most electrical connectors used in wire harnesses for automotive vehicles are fixed to the body of an automotive vehicle or components thereof with consideration given to such factors as suitability of positioning, the need to guard against vibrations, and the prevention of noise generation. In most cases, connectors are fixed to the relevant member after they have been brought into locked engagement, in other words, after male and female connector bodies have been coupled with each other. In these circumstances, if it were possible for confirmation to be made as to whether male and female connector bodies are in complete engagement during the fixing operation, the efficiency of assembly would be improved, and the possibility of incomplete coupling of the connector bodies would also be prevented.

SUMMARY OF THE INVENTION

The present invention was made with a view to solving the above-described problems which are inherent in prior art connectors and relies upon detecting any incomplete coupling of male and female connector bodies during a process by means of which electrical connectors are fixed the body of an automotive vehicle or components therefor.

More particularly, to solve the problems of the prior art, the present invention provides an electrical connector comprising a male connector body and a female connector body which are coupled and locked together to complete the mechanical connection of electrical terminals housed in the respective connector bodies, wherein a path is formed in the male connector body in such a manner as to correspond to the shape and dimension of a bracket which can be used in fixing the connector to the body of an automotive vehicle or components thereof, and a rib is provided on the female connector body, the rib being adapted to traverse the path when the female connector body is coupled with the male one and to block a part of the path in the event that the connector bodies fail to engage properly.

With an electrical connector according to the present invention, a fixing bracket is smoothly fitted in a path formed in the connector for that purpose when the male and female connector bodies thereof are in complete engagement since there is nothing blocking the path, thus allowing the connector to be fixed to the bracket. In contrast, when these connector bodies are not in complete engagement, the connector cannot be mounted on the bracket since the path is blocked by the rib provided on the female connector body. Thus any worker can immediatly detect the improper coupling of the connector bodies.

As a further method of solving the problems of the prior art, the present invention provides another type of electrical connector comprising male and female connector bodies of the above-described type wherein a support finger and a detection finger are provided on a bracket that is used in fixing the connector to the body of an automotive vehicle or components thereof, a path is formed in the male connector body in such a manner as to correspond to the shape and dimension of the support finger, a rib is provided on the rearward portion of the female connector body in such a manner as to bear against the detection finger when the two connector bodies are not in complete engagement, and the support finger is thus prevented from entering the path.

Thus, with this second type of electrical connector, the rib formed on the female connector body is adapted to bear against the detection finger when the male and female connector bodies thereof fail to assume a properly coupled condition, and the support finger is therefore prevented from entering the path.

On the other hand, when the two connector bodies are in a proper coupled condition, the detection finger slides over the back portion of the rib, and this allows the support finger to enter the path so as to support the connector.

In addition, in such a condition, the detection finger engages the back portion of the rib, and disconnection of the connector is thus prevented.

Many other advantages, features and additional objects of the present invention will become apparent to those skilled in the art upon making reference to the detailed description and the accompanying drawings in which preferred embodiments incorporating the principles of the present invention are shown by way of illustration only.

DETAILED DESCRIPTION OF THE PREFERRED EMBODIMENTS

Figure 1:
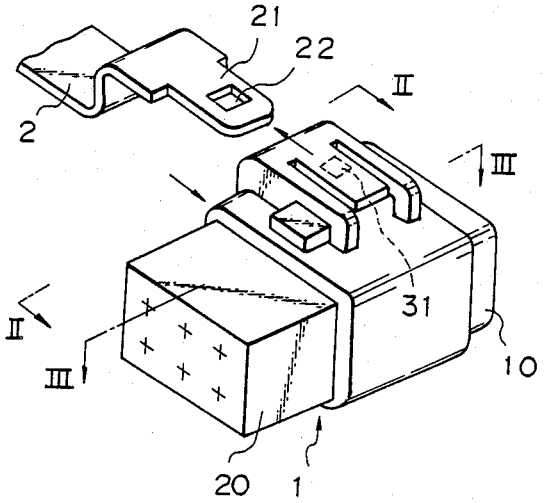
FIG. 1 is a perspective view of an electrical connector according to the present invention.
Figure 2:
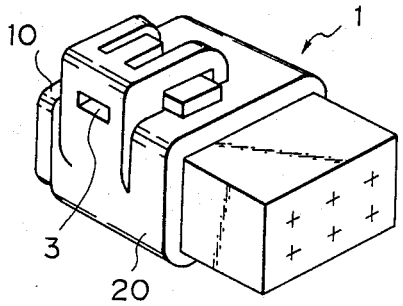
FIG. 2 is a perspective view looking in the direction shown by the arrows II of FIG. 1.

Referring to the accompanying drawings, one embodiment of an electrical connector according to the present invention will now be described. FIGS. 1 and 2 are perspective views of an electrical connector 1 according to the present invention. This electrical connector is configured to complete the mechanical connection of electrical terminals (not shown) housed in the female and male connector bodies 10, 20 thereof by coupling and locking together those two connector bodies.

As is described in the previous part of this specificaion, the electrical connector 1 is fixed to the body of an automotive vehicle or a bracket 2 of one of the components thereof. Such fixing of the connector is attained by inserting a forward portion 21 of the bracket 2 into a path 3 formed on the electrical connector 1 after the connector 1 has been properly coupled in such a manner that a projection 31 provided inside the path 3 fits in a hole 22 formed in the forward portion 21 of the bracket 2. The path 3 is formed in such a manner as to correspond to the shape and dimension of the forward portion of the bracket 2.

Figure 3:
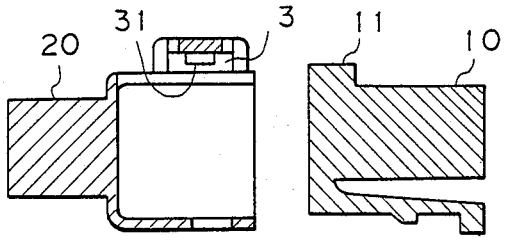
FIG. 3 is a longitudinal sectional view taken along the line III—III of FIG. I, which shows the male and female connector bodies in a disconnected condition.
Figure 4:
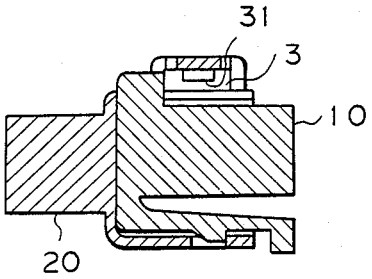
FIG. 4 is a longitudinal sectional view similar to FIG. 3 which shows the two connectors in a properly coupled condition.
Figure 5:
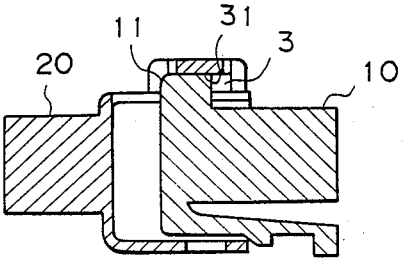
FIG. 5 is a longitudinal sectional view similar to FIG. 3 which shows the same two connector bodies in an incompletely coupled condition.

As shown in FIG. 3, a rib 11 is provided at a predetermined position on the female connector body 10 in such a manner as to traverse the path 3 when the female connector body 10 is mated with the male connector body 20. The rib 11 is preferably formed on the connector body 10 at such a location that has completely passed through the path 3 when the two connector bodies 10, 20 are properly mated with each other (FIG. 4) and blocks a part of the path 3 when the same two connector bodies 10, 20 are improperly mated (FIG. 5).

Thus, with the electrical connector 1 having a structure according to the present invention, since there is nothing blocking the path 3 formed on the connector 1 in which the bracket 2 is to be inserted when the female and male connector bodies 10, 20 are in a properly coupled condition (FIG. 4), the connector 1 is smoothly fitted over the bracket 2 so as to be fixed thereto. On the other hand, since the rib 11 on the female connector body 10 blocks a part of the bracket insertion path 3 when the female and male connector bodies 10, 20 are in an improperly coupled condition (FIG. 5), the connector 1 cannot be mounted on the bracket 2. Thus, workers can immediately detect the improper coupling of the connector 1.

The second type of electrical connector will now be described with reference to FIG. 6 through 12. The reference numbers used in FIGS. 1 through 5 are also used to indicate components and/or portions similar to those in the relevant figures, and a detailed description of those components and/or portions will be omitted.

The electrical connector 1 is fixed to the body of an automotive vehicle or a bracket 2 of one of the components thereof in the same way as that previously explained. When the support finger 21*a* of the bracket 2 is inserted into the path 3 (FIG. 7) formed in the electrical connector 1, a projection 31 provided inside the path 3 fits in a hole 22 formed in the support finger 21*a* of the bracket 2 and is locked in place, thus allowing the connector 1 to be fixed to the bracket 2. The path 3 is formed to correspond to the shape and dimension of the support finger 21*a* of the bracket 2.

Figure 6:
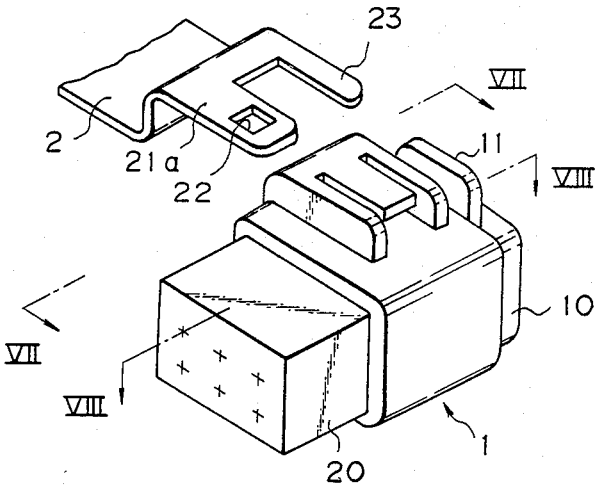
FIG. 6 is a perspective view of another type of electrical connector according to the present invention.
Figure 7:
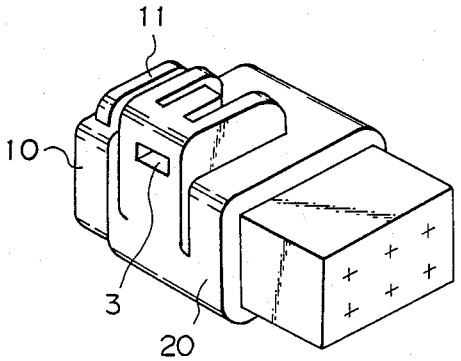
FIG. 7 is a perspective view looking in the direction shown by the arrows VII of FIG. 6.
Figure 8:
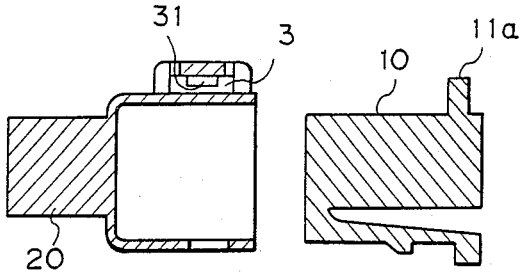
FIG. 8 is a longitudinal sectional view taken along the line VIII—VIII of FIG. 6 which shows the male and female connector bodies in a disconnected condition.
Figure 9:
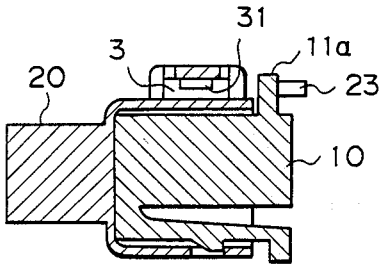
FIG. 9 is a longitudinal sectional view similar to FIG. 8 which shows the two connector bodies in a properly coupled condition.
Figure 10:
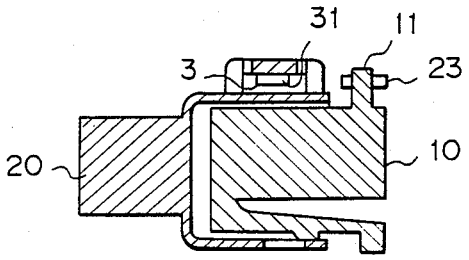
FIG. 10 is a longitudinal sectional view similar to FIG. 8 which shows the same connector bodies in an incompletely coupled condition.
Figure 11:
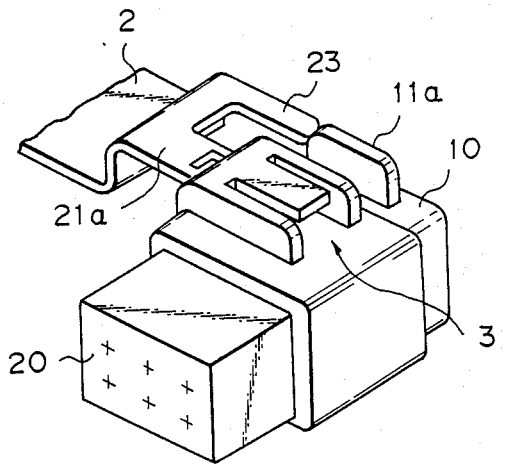
FIG. 11 is an explanatory diagram showing an incompletely coupled connector as being mounted on a bracket.
Figure 12:
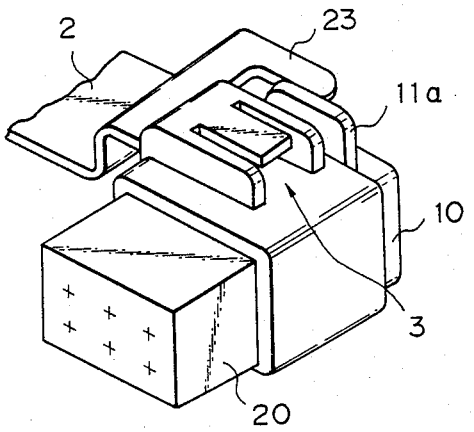
FIG. 12 is an explanatory diagram showing a properly coupled connector as being mounted on a bracket.

As shown in FIGS. 6 and 8, a detection finger 23 and a rib 11*a* are provided on the bracket 2 and the rearward portion of the female connector body 10, respectively. This rib 11*a* is provided in such a location that it is positioned outside the path 3 when the female connector body 10 and the male connector body 20 are mated with each other, and the detection finger 23 has along the back portion of the rib 11*a* when the two connector bodies 10, 20 are properly mated with each other (FIG. 9).

On the other hand, the rib 11*a* bears against the detection finger 23 of the bracket 2 (FIG. 11) when the two connector bodies 10, 20 are improperly coupled with each other (FIG. 10), entry of the support finger 21*a* into the path 3 thus being blocked.

As previously described, the rib 11*a* does not bear against the detection finger 23 when the connector bodies 10, 20 are properly mated with each other (FIG. 9), and this allows the support finger 21*a* to smoothly enter the path 3 to support and fix the electrical connector 1 thereto. In association with this entry of the support finger 21*a* into the path 3, the detection finger 23 engages the back portion of the rib 11*a*, thus making it possible to ensure fixing of the connector 1 even more reliably.

The present invention enables prevention of incomplete coupling of a connector, and this serves to eliminate the possibility of occurrence of electrical troubles in end products placed on the market. In addition, the present invention allows the connector to be fixed on the bracket, and this serves to ensure even stronger engagement of the male and female connector bodies.

The present invention, therefore, is well adapted to carrying out the objects and attaining the ends and advantages mentioned, as well as others inherent therein. While presently preferred embodiments of the invention are given for the purpose of disclosure, numerous changes in the details of construction and arrangement of parts may be made which will readily suggest themselves to those skilled in the art and which are encompassed within the spirit of the invention and scope of the appended claims.

What is claimed is:

1. An electrical connector and mounting means therefor, comprising:

a male connector having a male connector body;

a female connector having a female connector body joinable with said male connector body along an axis for forming the connector; and a support bracket for supporting said connector on another structure, said support bracket having a support finger and a detection finger projecting substantially parallel to each other and transversely to said axis;

one of said connector bodies having a path therethrough corresponding to the shape and dimensions of said support finger and into which said support finger is insertable for supporting said connector on said bracket, and the other of said connector bodies having a rib thereon, said rib being positioned, when said connector bodies are improperly coupled, for being abutted by said detection finger for preventing entry of said support finger into said path, and said rib being positioned, when said connector bodies are properly coupled, for being engaged by said detection finger for blocking movement of said other connector body relative to said one connector body transverse to said axis.

2. An electrical connector and mounting means therefor as claimed in claim 1 in which said rib extends parallel to the direction in which said detection finger projects, and is positioned for having the side of the rib which is remote from the one connector body engaged by at least a portion of the length of said detection finger.

* * * * *